US010598372B1

(12) United States Patent
Waldraff

(10) Patent No.: US 10,598,372 B1
(45) Date of Patent: Mar. 24, 2020

(54) WORKING FLUID GENERATOR WITH INDUCTION HEATING COIL

(71) Applicant: Michael Waldraff, Batvia, NY (US)

(72) Inventor: Michael Waldraff, Batvia, NY (US)

( * ) Notice: Subject to any disclaimer, the term of this patent is extended or adjusted under 35 U.S.C. 154(b) by 355 days.

(21) Appl. No.: 15/469,194

(22) Filed: Mar. 24, 2017

Related U.S. Application Data

(60) Provisional application No. 62/313,721, filed on Mar. 26, 2016.

(51) Int. Cl.
*F22B 1/28* (2006.01)

(52) U.S. Cl.
CPC ..... *F22B 1/281* (2013.01)

(58) Field of Classification Search
CPC ..... F22B 1/281; F22B 1/282; F22B 1/284; F22B 1/285; F22B 1/28; F22B 1/00; F22B 5/00; F22B 1/288; F22B 1/30; F22B 1/303; F22B 1/306
USPC ..... 219/628–630; 392/303–304, 308, 311, 392/314–316, 319–325, 339–345, 386, 392/394, 396–400, 465–489
See application file for complete search history.

(56) References Cited

U.S. PATENT DOCUMENTS

| | | | | |
|---|---|---|---|---|
| 6,011,245 | A | 1/2000 | Bell | |
| 6,598,397 | B2 | 7/2003 | Hanna et al. | |
| 6,967,315 | B2 * | 11/2005 | Centanni | A61L 2/07 219/628 |
| 7,827,860 | B2 * | 11/2010 | Weis | F04D 15/0088 73/168 |
| 8,664,785 | B2 | 3/2014 | Madison | |
| 2013/0094909 | A1 * | 4/2013 | McAlister | E02D 3/11 405/130 |

* cited by examiner

*Primary Examiner* — Tu B Hoang
*Assistant Examiner* — Diallo I Duniver
(74) *Attorney, Agent, or Firm* — Keeley DeAngelo LLP

(57) ABSTRACT

A working-fluid generator comprising an electrically conductive vessel that is surrounded by an inductive coil and has conductive, longitudinal members that extend through the vessel. A fluid inlet passes through a one-way valve. Fluid heated by the interaction between the inductive coil and the combination of conductive vessel and conductive, longitudinal members is converted to working fluid in the form of a gas that builds pressure in the air-filled space inside the vessel. Air in the pressurized gas is released through a valve, leaving a working fluid. This fluid is controllably released through a solenoid valve and into a conduit leading to a working-fluid-driven machine. A renewable-energy resource may be used to preheat the fluid to be introduced to the working-fluid generator.

4 Claims, 4 Drawing Sheets

200

WORKING FLUID GENERATOR WITH INDUCTION HEATING COIL

CLAIM OF PRIORITY

The present non-provisional patent application claims priority to provisional patent application No. 62/313,721 having a filing date of Mar. 26, 2016.

TECHNICAL FIELD

The present disclosure relates generally to energy storage and energy conversion and specifically to working-fluid generators that convert steam energy to mechanical energy. A working fluid is generated by rapidly heating a contained fluid to a gaseous state, and regulating the release of the working fluid through a valve. Rapid heating can be achieved through induction heating.

BACKGROUND

Renewable energy is collected from renewable sources such as sunlight, wind, rain, tides, waves and geothermal heat. Renewable energy is commonly used for generating electricity and for the heating or cooling of fluids.

Energy storage is the capture of energy for use at a later time. Acquiring energy for storage involves converting it to a storable form. An apparatus for storing energy may be referred to as an accumulator. Energy storage is an important aspect of renewable energy as the energy available is not regularly available when needed, nor needed when available. In one example, a passive solar heating system designed to produce sufficient heat for a living space in winter months continues to generate heat in summer months. In this example, the heat generated in the summer months is not needed to heat the living space and needs to be dispelled. This excess heat is commonly referred to as waste heat. Extracting waste heat energy and converting it to mechanical or electrical energy is a means of dispelling the waste heat while producing energy.

A working fluid is a pressurized gas or liquid that powers a machine. Examples include steam in a steam engine, air in a hot-air engine and hydraulic fluid in a hydraulic motor or hydraulic cylinder. In a thermodynamic system, the working fluid is a liquid or gas that absorbs or transmits energy.

A steam engine is a heat engine that uses the working fluid of steam to perform mechanical work. A steam engine is an external combustion engine wherein the working fluid is separate from the combustion product. Non-combustion heat sources such as solar energy, nuclear energy or geothermal energy may alternatively be used to create a working fluid.

The Rankine Cycle is a method that heats water to a high-pressure gas for purposes of converting a working fluid to mechanical energy. When the steam is expanded through at least one piston or turbine, the energy is transformed into mechanical work. Reduced-pressure fluid is exhausted to the atmosphere or condensed and returned to the boiler.

Conventionally, induction heating is the process of heating an electrically conducting object by electromagnetic induction, through heat generated in the object by eddy currents (also known as Foucault currents). An induction heater consists of an electromagnet and an electric oscillator that passes a high-frequency alternating current (AC) through the electromagnet, producing a rapidly alternating magnetic field. The rapidly alternating magnetic field is directed through a working coil toward the electrically conducting object, penetrating the electrically conducting object. This generates the electric eddy currents inside the electrically conducting object. The eddy currents flowing through the material encounter the material's resistance, resulting in joule heating of the material.

Joule heating, also known as ohmic or resistive heating, is the process by which the passage of an electric current through a conductor releases heat. The amount of heat released is proportional to the square of the current such that:

$$H \propto I^2 * R * t$$

Where 'H' represents heat, 'I' represents current, 'R' represents resistance and 't' represents time.

In ferromagnetic materials, heat may also be generated by magnetic hysteresis, in which the value of a physical property lags behind changes in the effect causing it, as for instance when magnetic induction lags behind the magnetizing force.

The frequency of current applied depends on the object size, material type, and coupling between a work coil and the depth of penetration.

A solenoid valve is an electromechanically operated valve that is controlled by an electric current through a solenoid. In a two-port solenoid valve, flow is switched on or off. Solenoid valves are most frequently used in fluidics for shutting off, releasing, dosing, distributing or mixing fluids. Solenoid valves are often employed for their rapid switching ability and high reliability.

An automatic bleeding valve or air-release valve (ARV) is a plumbing valve used to automatically release trapped air from a fluid system. Air trapped in a closed system can cause impede liquid flow or cause cavitation, reducing the system's efficacy and possibly causing a system to overheat. An ARV allows air to separate from fluid and exit the system.

A check valve, one-way valve or non-return valve allows fluid to flow in only one direction. Check valves are two-port valves, meaning they have two openings, one for fluid to enter and the other for fluid to exit. Check valves work automatically, needing no valve-handle operation.

SUMMARY

In accordance with example embodiments of the present disclosure, a method and apparatus for converting waste heat to mechanical energy is disclosed. In some embodiments mechanical energy may be converted to electrical energy. An example embodiment includes a working-fluid generator having an induction heating coil is coupled to an energy accumulator for purposes of providing pre-heated fluid to the working-fluid generator. Working fluid from the working-fluid generator may be employed to run an electrical generator. In another embodiment, a method and apparatus for preheating and storing fluid; converting preheated fluid to a working fluid; and converting a working fluid to mechanical energy and for converting mechanical energy to electricity is disclosed.

An insulated storage tank, referred to as an accumulator, holds a volume of fluid in liquid state. The fluid is heated by a renewable energy source such as passive solar. The heated fluid is converted to electricity which is in turn used to heat fluid in an insulated fluid storage tank. In other embodiments renewable energy sources that involve the passive transfer of heat are used to heat fluid in an accumulator. Preheated fluid from the accumulator is fed to a working-fluid generator to generate a working fluid.

An example embodiment of a working-fluid generator is a vessel having an electrically conductive material that contains an amount of fluid in liquid state. Cross-members, referred to as heat-transfer rods, being electrically conductive and having heat-transfer properties, extend through the vessel and meet the outer surface of the vessel. An induction coil surrounds the outer surface of the vessel. A solenoid valve, an air-release valve, and a one-way (check) valve control the transfer of preheated fluid into the vessel as well as the transfer of working fluid out of the vessel. Working fluid may be used to run an electrical generator.

Engaged with the vessel is an inlet with a check valve; this inlet is for filling the vessel with fluid. The upper surface of the vessel has an outlet controlled by a solenoid valve. The solenoid valve allows the controller to open the valve for appropriate timing as required by any working-fluid driven machine. An air-release valve allows air to escape while keeping the working fluid inside.

An induction emitter is engaged with a continuous induction loop that begins at a terminal on the induction emitter, coils around the vessel and returns to a second terminal on the induction emitter. The induction loop is made of electromagnetically conductive material. The induction loop coils around the outer surface of the vessel. The section of induction loop that coils around the vessel is referred to as the induction coil.

The induction emitter consists of an electromagnet and an electric oscillator that passes a high-frequency alternating current (AC) through the electromagnet, producing a rapidly alternating magnetic field. The rapidly alternating magnetic field is directed through the induction coil and is in turn directed through the electrically conductive vessel and the heat-transfer rods that extend through it. Electric eddy currents flow through the surface material of the vessel and also through the heat-transfer rods. Upon encountering resistance in the material of the coil, vessel, and rods, heat is produced.

The frequency of current applied depends on the object size, material type, and coupling between a work coil and the depth of penetration. Heat transfer rods increase the surface area that is in contact with the fluid in the vessel. From the equation:

$$H \propto I^2 * R * t$$

One skilled in the art understands that the heat transfer rods increase the surface area and mass of the vessel, thus increasing the resistance (R) in the above equation. Rapidly alternating current in the surface area of the vessel and in the heat-transfer rods rapidly heats the fluid in the vessel, thus converting it to a working fluid with sufficient rapidity as to keep pace with a steam engine.

Air is released through the ARV and the working fluid is controllably released through the solenoid valve. The working fluid may be used to operate a steam-driven motor for various applications including mechanical power and electrical generation.

One skilled in the art will understand that various configurations may be developed that provide similar combinations of surface and heat-transfer members. The embodiment described is intended for illustration purposes and is not intended to be limiting in scope. One skilled in the art will understand that various fluids may be employed to generate the working fluid.

BRIEF DESCRIPTION OF THE DRAWINGS

To assist those of skill in the art in making and using the disclosed working fluid generator and associated methods, reference is made to the accompanying figures, wherein.

DESCRIPTION

Figure 1:
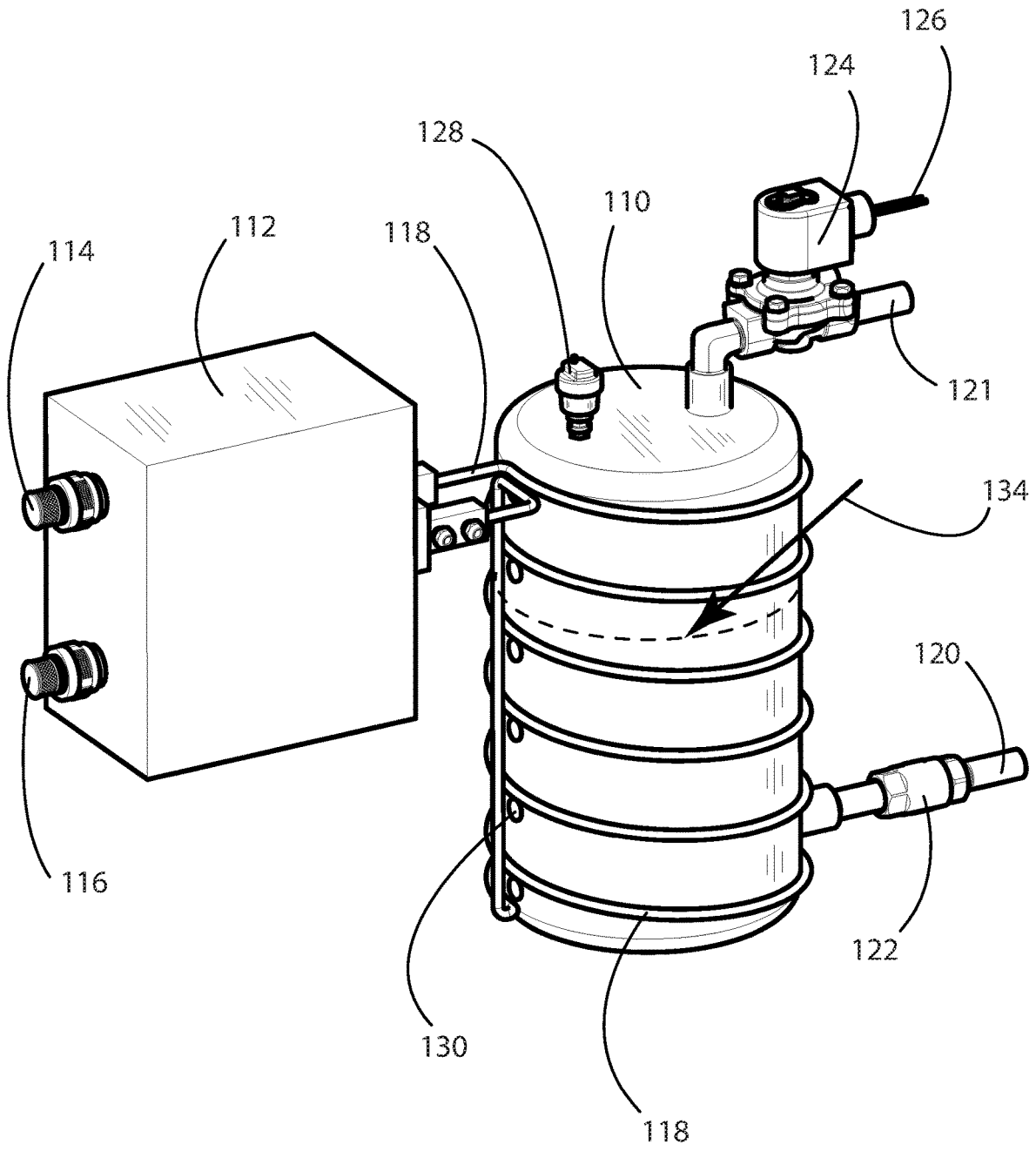
FIG. 1 is a perspective view of an example embodiment.
Figure 2:
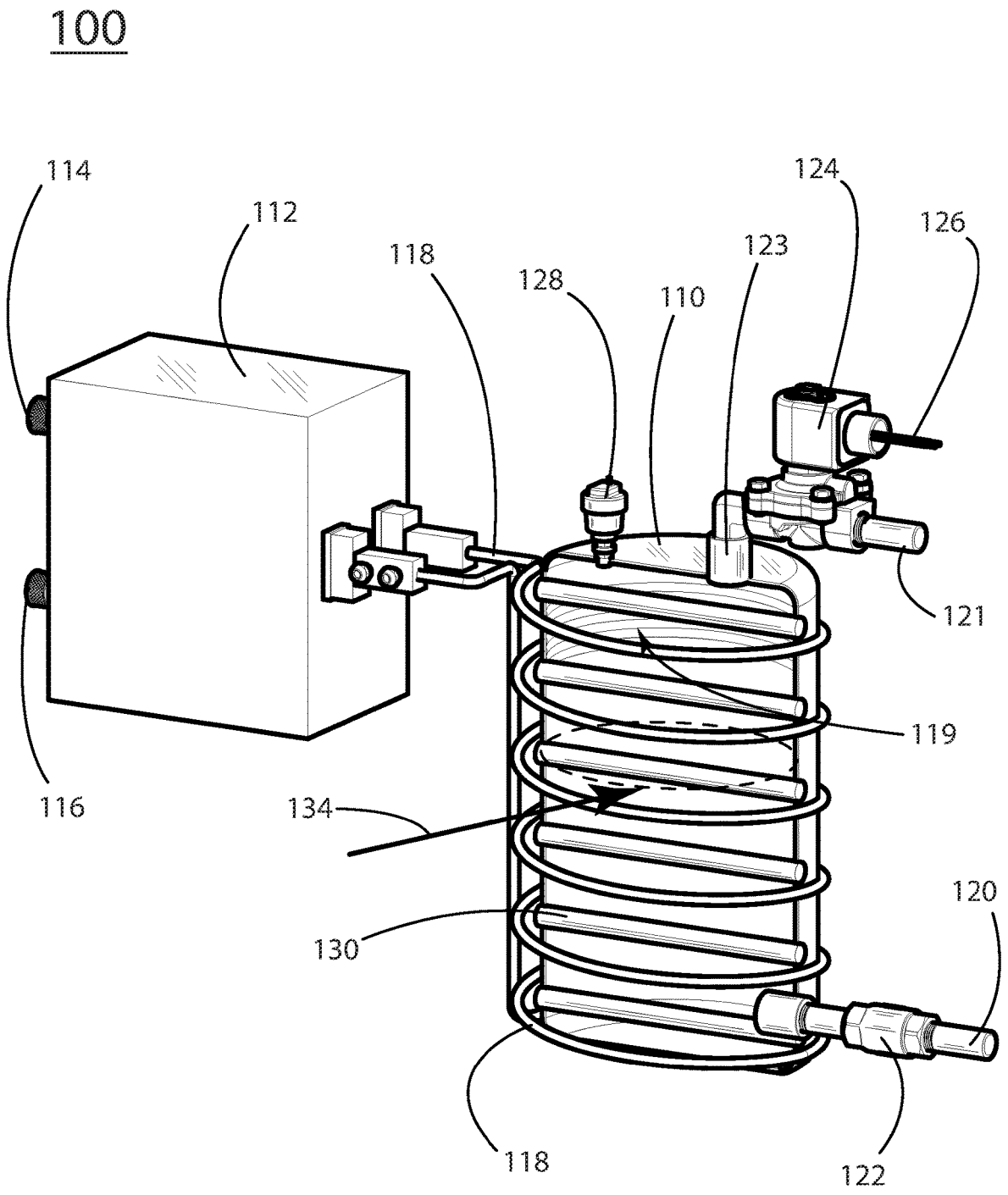
FIG. 2 is a perspective, semi-cross section view of the embodiment of FIG. 1.

Referring to FIG. 1 and FIG. 2, a vessel 110 contains an amount of fluid in liquid state. The vessel 110 is filled with fluid approximately to a fill line 134. The vessel 110 is comprised of an electrically conductive material. Cross-members, referred to as heat-transfer rods 130, extend through the vessel, with each of their ends touching the outer surface of the vessel 110. The ends of the heat-transfer rods 130 are shown on the outer surface of the vessel 110 in FIG. 1, and are shown extending through the interior of the vessel 110 in FIG. 2. At least a portion of the interior surface of the vessel 110 is textured for the purpose of increasing the surface area of the vessel interior that is in contact with the fluid on the interior of the vessel 110. A texture 119 may be fabricated by threading the inner walls of the vessel 110 to create a pipe-thread texture 119. One skilled in the art understands that textures including an array of ribs, fins or tubes may also be fabricated to create a texture 119 on the interior of the vessel 110. A solenoid valve 124 pierces the vessel 110 via a standard plumbing fitting. An air-release valve 128 and a one-way/check valve 122 also pierce the vessel via standard plumbing fittings.

A conduit 120 is intended to be connected to a source of fluid for filling the vessel 110. The conduit 120 has a check valve 122 to prevent back-flow from the vessel 110 back into the conduit 120, wherein, an increase in pressure inside the vessel 110 is not lost through the conduit 120.

An exit tube 123 connects to a solenoid valve 124. The solenoid valve 124 has an electrical input 126 and a fluid outlet 121. Electrical charge through the input 126 opens the normally closed valve and allows working fluid to exit the vessel 110 and pass through the outlet 121.

The upper surface of the vessel 110 has an air-release valve 128 that allows air to escape without allowing working fluid to escape.

An induction emitter 112 comprises electrical inputs 114 and 116 and a continuous induction loop, referred to as the induction coil 118, which is comprised of electro-magnetically conductive material that is coiled about an area proximal to the outer surface of the vessel 110. The induction emitter 112 employs an electromagnet and an electric oscillator. A high-frequency alternating current (AC) is sent through an electromagnet, producing a rapidly alternating magnetic field. Induction emitters are well known in the art; its interior is therefore not shown here for the purpose of clarity. The rapidly alternating magnetic field is directed through the induction coil 118 and is in turn directed toward the electrically conductive vessel 110 and the heat-transfer rods 130. Electric eddy currents produced by the induction emitter flow through the induction coil 118 into the vessel and also through the heat-transfer rods 130, producing heat upon encountering resistance in the materials of each.

The combined surface area of the vessel 110 and the heat-transfer rods 130 rapidly heats the fluid in the vessel 110, thus converting it to a working fluid in a gaseous state. The now-gaseous working fluid is then further heated by the upper-most heat-transfer rods 130. Air is released through the ARV 128 and the working fluid is controllably released by the solenoid valve 124 through the outlet 121.

Figure 3:
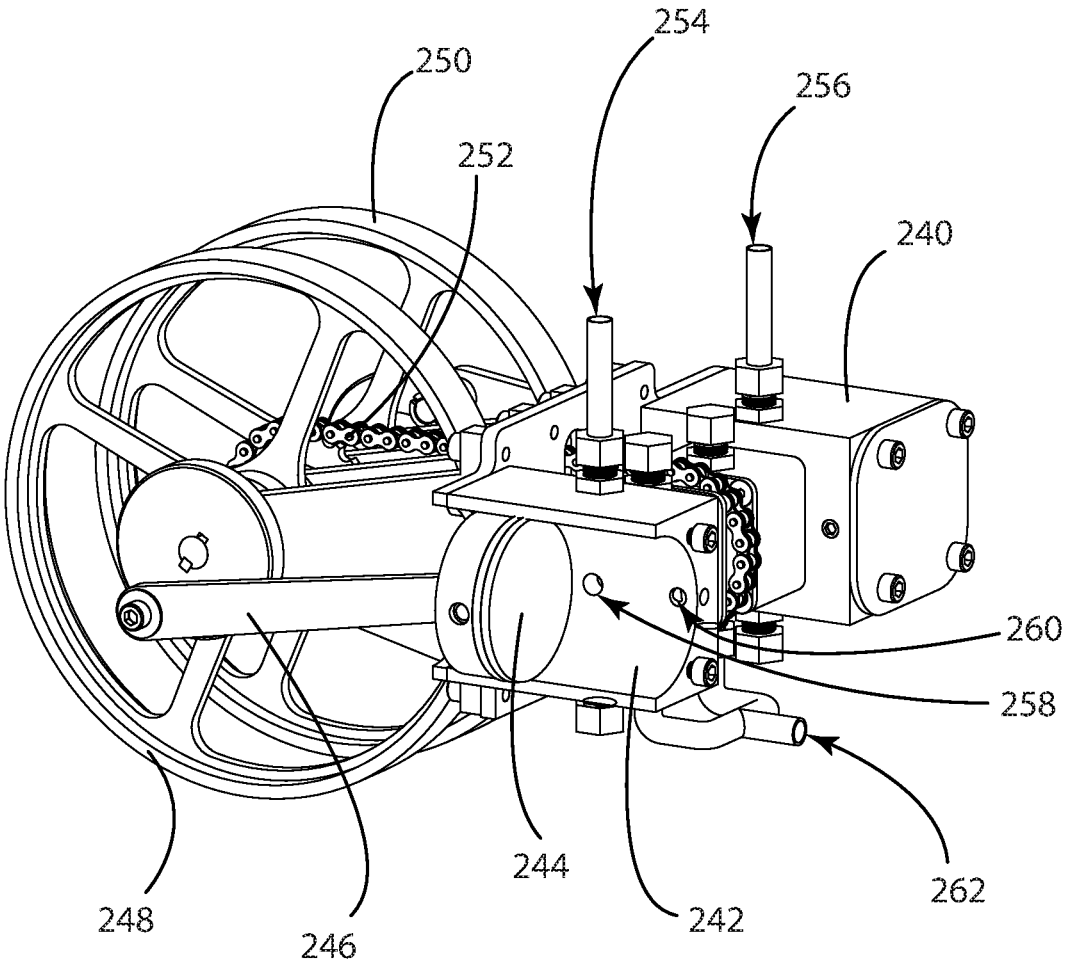
FIG. 3 is a perspective, semi-cross section of an example steam engine.

Referring to FIG. 3, an example steam engine is illustrated. One skilled in the art understands that there are numerous variations on a steam engine and the example is shown to illustrate a means of converting a working fluid to mechanical energy. One skilled in the art also understands that mechanical energy may be used for any number of mechanical functions, including electricity generation. The example steam engine comprises at least one piston, at least one linkage and at least one flywheel.

In the example illustrated, a first piston block 240 has a working fluid inlet 256 and drives a first flywheel 250. The first piston block is identical to a second piston block 242, which houses a piston 244. The piston 244 is moved when a working fluid is injected into the working fluid port 254 and enters the piston chamber through working fluid port 260. The working fluid entering the working fluid port 260 drives the piston 244 along the chamber until the piston 244 passes the working fluid exhaust port 258 where the working fluid travels out of the exhaust conduit 262. As the piston is driven by the working fluid, the linkage 246 moves in a linear motion that is transferred to a rotational motion to drive flywheel 248. A linkage chain drive 252 maintains timing between the two pistons and flywheels.

Figure 4:
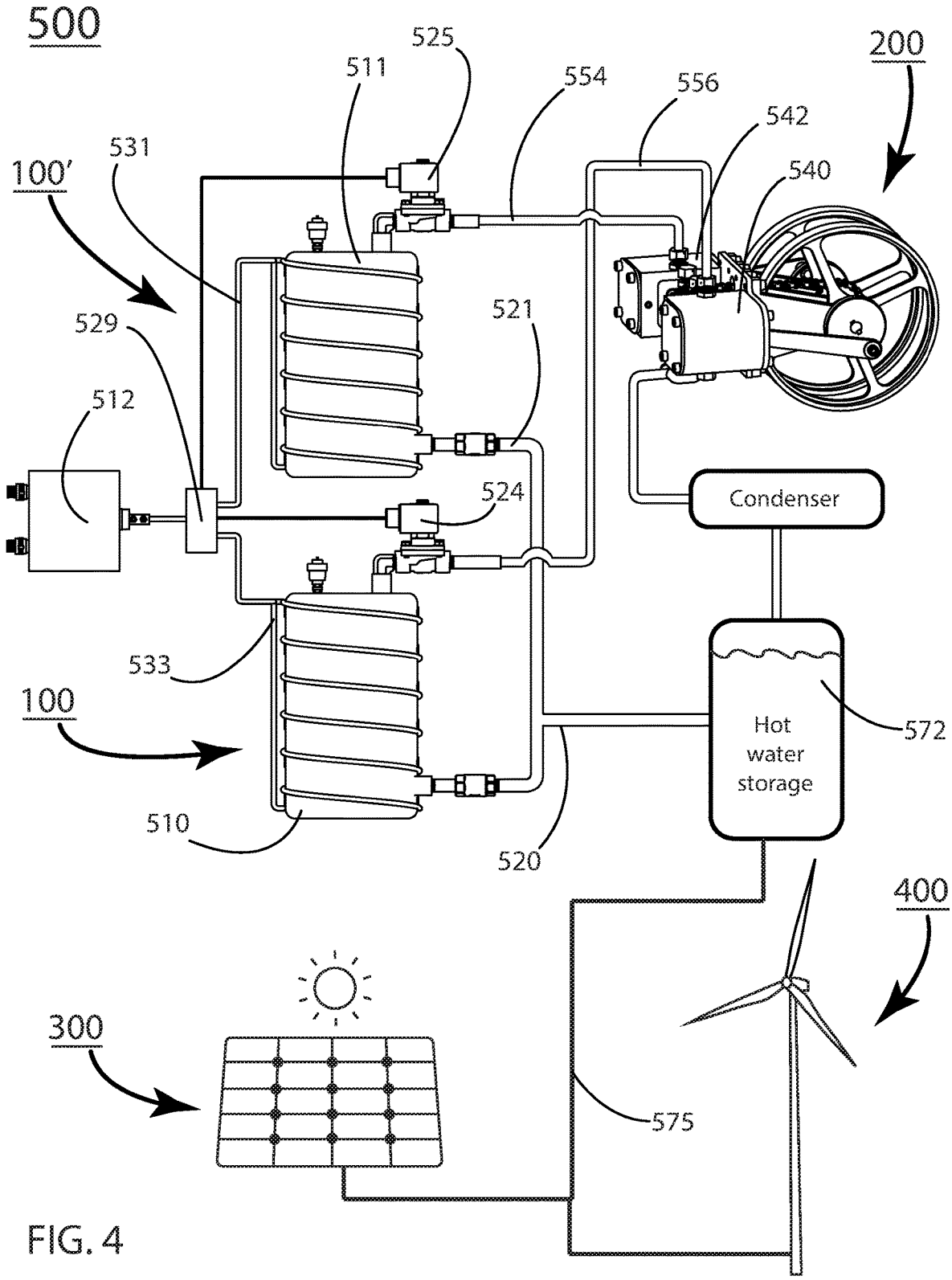
FIG. 4 is a diagrammatic view of an example system of the embodiment.

Referring to FIG. 4, an example system and method of the present embodiment is illustrated. Energy from renewable resources is accumulated as hot water in a hot water storage tank 572. Energy is collected by renewable energy sources including solar energy capture device 300 or wind energy device 400. Energy from renewable resources is transferred as heat or electricity by heat-transfer/electrical conduit 575 to a hot water storage tank 572.

Hot water from the hot water storage tank 572 is transferred by conduit 520 to a first working-fluid generator 100 where it is stored in the working fluid generator tank 510. An induction emitter 512 heats the water to steam so as to provide a working-fluid as described in FIG. 1.

The controller 529 controls the flow of power to the working fluid production system 500. A first solenoid valve 524 and a second solenoid valve 525 are electrically connected with a controller 529. The flow of working fluid to the pistons of the steam engine 200 are controlled by the controller by switching the solenoid valves 524 and 525 by an appropriate timing to drive the two pistons of the steam engine 200. The controller also controls the flow of energy to induction coils 533 (in the first working fluid generator) and coil 531 in the second working fluid generator 100'. In the disclosed example, one working fluid generator provides working fluid to a piston in a steam engine while a second working fluid generator is heating fluid to provide working fluid to a second piston subsequently. One skilled in the art understands that more or fewer working fluid generators may be used depending on the steam engine timing and number of pistons. In other words, a functioning system may be achieved with one working-fluid generator and a steam engine with one piston, while another functioning system may be achieved with four working fluid generators and two pistons and so on.

An example of the function and timing is as follows: an induction emitter 512 is controlled by the controller 529 and sends induction energy through induction coil 533. The induction coil 533 heats water in the working-fluid generator tank 510 sufficiently to convert the hot water to a working fluid. In some embodiments one ounce of liquid is converted to 250-350 psi of working fluid in between 25-65 seconds. The working fluid is released by solenoid valve 524 and is transferred along conduit 556 to drive piston 540 in the steam generator 200. The controller 529 then switches the distribution of power such that the induction emitter 512 sends induction energy along coil 531 to secondary working-fluid generator 100' to tank 511 where the hot water from the hot water storage tank 572 that is fed along conduit 521 to tank 511, is heated to a working fluid. The solenoid valve 525 is opened by a signal from the controller 529 such that it releases the working fluid through conduit 554 to piston 542 to turn the steam engine 200.

A steam engine 200 having a first piston block 240 and second piston block 242 is driven by working fluid provided by at least one working fluid generator 500. The present example illustrates a two-piston 540/542 steam engine and two working fluid generators 510 and 511.

One skilled in the art understands that renewable energy includes more example embodiments than have been illustrated. Renewable energy collected in the form of electrical energy or heat energy may be converted to heat used to heat water in a storage tank 572.

The invention claimed is:

1. A working fluid generator comprising:

An electrically conductive vessel having an inlet and an outlet, and;

said electrically conductive vessel, having at least a left side and a right side, fixedly engaged with at least two electrically conductive members that pierce at least one side of said electrically conductive vessel; and said electrically conductive members each having a left end and a right end, fixedly engaged with said left side and said right side, respectively, of said electrically conductive vessel; and said two electrically conductive members being a first member and a second member; and said electrically conductive vessel further engaged with an inlet conduit fixedly engaged with said inlet, for filling the electrically conductive vessel; and said electrically conductive vessel fillable with a fluid at least part way; and the remaining part of said electrically conductive vessel filled with air; and said first member residing in the liquid within the electrically conductive vessel and said second member residing in the space above said liquid; and said inlet conduit fluidly engaged with a one-way valve, proximal to the electrically conductive vessel inlet; and said electrically conductive vessel fixedly engaged with a conduit that is fluidly engaged with a solenoid valve; and said solenoid valve is fluidly engaged with an interior of an outlet conduit, which is in turn, fluidly engaged with, said electrically conductive vessel outlet; and said electrically conductive vessel further engaged with an air release valve that is fixedly engaged with at least one wall of said vessel and is in fluid communication with the interior of said vessel; and in combination, the electrically conductive vessel and at least two electrically conductive members are surrounded by an induction coil that is structurally engaged proximal to the outer surface of said electrically conductive vessel; and an induction emitter structurally engaged with and coupled with said induction coil for the purpose of emitting a rapidly alternating magnetic field through the induction coil and in turn through the electrically conductive vessel and the at least two electrically conductive members; and said rapidly alternating magnetic field producing heat when meeting resistance in the electrically conductive vessel and the at least two electrically conductive members; and said heat transferring through said electrically conductive vessel and the at least two electrically conductive members and to said fluid, thus converting said fluid to a working fluid in the form of a gas that builds inside the vessel; and said second member providing heat to said working fluid; and said air in said vessel, allowed to escape through said air release valve; and said working fluid controllably released through said solenoid valve through said outlet conduit for the purpose of providing a working fluid to a working fluid driven machine.

2. The apparatus of claim 1 wherein the inner surface of said electrically conductive vessel has an interior surface that is textured.

3. The apparatus of claim 1 wherein 1 ounce of liquid is converted to between 250 and 350 psi in between 25 and 65 seconds when said heat is transferred to said liquid.

4. The apparatus of claim 1 wherein the conduit for filling the electrically conductive vessel is engaged with an insulated fluid storage tank; and said insulated fluid storage tank is engaged with a heating element; and said heating element is electrically coupled with a renewable energy source; wherein said renewable energy source provides heat to the fluid in said insulated fluid storage tank for the purpose of raising the temperature of fluid entering said electrically conductive vessel and reducing the energy required to convert said fluid to a working fluid.

* * * * *